US009303383B2

(12) United States Patent
Tan et al.

(10) Patent No.: US 9,303,383 B2
(45) Date of Patent: Apr. 5, 2016

(54) LIFT ARM CROSS MEMBER

(75) Inventors: Xiaoming Tan, Apex, NC (US); Michael Scott Sekulich, Raleigh, NC (US); Anand Ramchandra Mijar, Raleigh, NC (US)

(73) Assignee: Caterpillar Inc., Peoria, IL (US)

( * ) Notice: Subject to any disclaimer, the term of this patent is extended or adjusted under 35 U.S.C. 154(b) by 862 days.

(21) Appl. No.: 13/543,461

(22) Filed: Jul. 6, 2012

(65) Prior Publication Data

US 2014/0010623 A1 Jan. 9, 2014

(51) Int. Cl.
*E02F 3/28* (2006.01)
*E02F 3/34* (2006.01)

(52) U.S. Cl.
CPC ..... *E02F 3/34* (2013.01); *E02F 3/3411* (2013.01)

(58) Field of Classification Search
CPC ..... E02F 3/34
USPC ..... 414/715
See application file for complete search history.

(56) References Cited

U.S. PATENT DOCUMENTS 4,034,876 A * 7/1977 Yancey ..... 29/897.2
4,349,307 A 9/1982 Klem
4,798,512 A * 1/1989 Intveld ..... 414/722
4,858,345 A 8/1989 Abe et al.
4,904,151 A * 2/1990 Biemans et al. ..... 414/727
5,156,520 A 10/1992 Ericson et al.
5,292,079 A 3/1994 Zakohji
5,553,408 A 9/1996 Townsend
5,813,822 A 9/1998 Pisco
5,988,309 A 11/1999 Chong et al.
6,098,870 A 8/2000 Deneve et al.
6,450,081 B1 9/2002 Sorbel
7,165,930 B2 1/2007 Pisco
7,383,681 B2 6/2008 Connolly et al.
7,533,481 B2 5/2009 McCoy
7,818,901 B2 10/2010 Zeno et al.
2004/0194355 A1 * 10/2004 Stock ..... 37/408
2006/0291987 A1 12/2006 Osanai et al.
2012/0128456 A1 5/2012 Grimes et al.

* cited by examiner

*Primary Examiner* — Scott Lowe
(74) *Attorney, Agent, or Firm* — Miller, Matthias & Hull LLP

(57) ABSTRACT

A lift arm cross member may connect a tilt lever support to a pair of lift arms. The lift arm cross member may have a top plate with a generally convex outer surface as the outer surface extends from a first end edge to a second end edge, and a bottom plate having first and second end edges, a first planar portion extending from the second end edge, and a curved portion extending from the first planar portion opposite the second end edge. The first end edge of the bottom plate may be connected to an inner surface of the top plate and the second end edge of the first plate may be connected to an inner surface of the bottom plate. A buffer plate may be provided within the lift arm cross member and extend between the inner surfaces of the top and bottom plates.

16 Claims, 8 Drawing Sheets

LIFT ARM CROSS MEMBER

TECHNICAL FIELD

This disclosure relates generally to machines having articulating ground-engaging implements and, in particular, to support structures for tilt cylinders that control the movement of such articulating implements.

BACKGROUND

Machines, such as wheel loaders, track loaders, backhoe loaders and the like known in the art, are used for moving material from one place to another at a worksite. These machines include a body portion housing the engine and having rear wheels driven by the engine and an elevated operator environment, such as a cab, for the operator. In wheel loader machines, a front non-engine end frame with the front wheels is attached to the body portion by an articulated connection allowing the end frame to pivot from side-to-side to steer the machine. The end frame may further include linkages, such as Z-bar linkages, for manipulating an implement of the machine. A pair of lift arms coupled to the end frame are raised and lowered by corresponding lift cylinders to adjust the elevation of the implement above the ground. Where Z-bar linkages are used, the tilt of the implement (rotation of the implement about a pivot connection at the end of the lift arms) is controlled by a tilt lever and tilt link coupled between the lift arms and the implement, and driven by a tilt cylinder. Examples of wheel loader machines implementing a Z-bar linkage area provided in U.S. Publication No. 2006/0291987, published on Dec. 28, 2006 and U.S. Publication No. 2012/0128456, published on May 24, 2012. Other types of machines and other types of linkages having tilt cylinders operatively coupled to their implements are also known in the art.

When operating machines with linkages, the operator may look between the lift arms to view the implement and the work area as the implement operates on work material and the wheel loader moves around the work area. Other elements of the linkage partially obstruct the operator's view. One component of the linkage is a lift arm cross member that extends between and unitizes the lift arms, and has a support member for the tilt lever mounted thereto. The lift arm cross member stabilizes the lift arms and assists in bearing forces created by offset or uneven loads on the implement, and transmits loads from the tilt lever support to the lift arms. Consequently, the cross member is an integral structural element of the linkage and should have sufficient strength to bear the expected loads. As a result, current cross members have a box-like configuration with sufficient size and strength, but create a significant visual obstruction for the operator. Therefore, a need exists for cross member designs that provide sufficient structural integrity while reducing the amount of obstruction for the operator's view when looking between the lift arms.

SUMMARY OF THE DISCLOSURE

In one aspect of the present disclosure, a lift arm cross member is disclosed for connecting a tilt lever support of a machine between a pair of lift arms of the machine. The lift arm cross member may include a first plate having oppositely disposed first and second end edges, oppositely disposed first and second lateral edges, an outer surface having a convex curvature as the outer surface extends from the first end edge to the second end edge, and an inner surface opposite the outer surface, the first lateral edge of the first plate being connected to an inner surface of one of the lift arms. The lift arm cross member may further include a second plate having oppositely disposed first and second end edges, oppositely disposed first and second lateral edges, an outer surface having a first planar portion proximate the second end edge and a curved portion extending from the first planar portion opposite the second end edge, and an inner surface opposite the outer surface of the second plate, the first lateral edge of the second plate being connected to the inner surface of the lift arm to which the first lateral edge of the first plate is connected, the first end edge of the second plate being connected to the first plate proximate the first end edge of the first plate, and the second end edge of the first plate being connected to the second plate proximate the second end edge of the second plate.

In another aspect of the present disclosure, a lift arm cross member is disclosed for connecting a tilt lever support of a machine between a pair of lift arms of the machine. The lift arm cross member may include a first top plate having oppositely disposed first and second end edges, oppositely disposed first and second lateral edges, an outer surface having a convex curvature as the outer surface extends from the first end edge to the second end edge, and an inner surface opposite the outer surface, the first lateral edge of the first top plate being connected to an inner surface of one of the lift arms. The lift arm cross member may also include a bottom plate having oppositely disposed first and second end edges, oppositely disposed first and second lateral edges, an outer surface having a first planar portion proximate the second end edge and a curved portion extending from the first planar portion opposite the second end edge, and an inner surface opposite the outer surface of the bottom plate, the first lateral edge of the bottom plate being connected to the inner surface of the lift arm to which the first lateral edge of the first top plate is connected, the first end edge of the bottom plate being connected to the first top plate proximate the first end edge of the first top plate, and the second end edge of the first top plate being connected to the bottom plate proximate the second end edge of the bottom plate. The lift arm cross member may further include a buffer plate having oppositely disposed first and second end edges, and oppositely disposed first and second lateral edges, the first lateral edge being connected to the inner surface of the lift arm to which the first lateral edge of the first top plate is connected, the first end edge of the buffer plate being connected to the inner surface of the first top plate, and the second end edge of the buffer plate being connected the inner surface of the bottom plate.

In a further aspect of the present disclosure, a lift arm assembly of a machine is disclosed. The lift arm assembly may include a first lift arm having an inner surface and an outer surface, a second lift arm having an inner surface and an outer surface, and a tilt lever support having first outer surface, a second outer surface disposed opposite the first outer surface, and a bottom end. The lift arm assembly may also include a first top plate having oppositely disposed first and second end edges, oppositely disposed first and second lateral edges, an outer surface having a convex curvature as the outer surface extends from the first end edge to the second end edge, and an inner surface opposite the outer surface, the first lateral edge of the first top plate being connected to the inner surface of the first lift arm, and the second lateral edge of the first top plate being connected to the first outer surface of the tilt lever support, and a bottom plate having oppositely disposed first and second end edges, oppositely disposed first and second lateral edges, an outer surface having a first planar portion proximate the second end edge and a curved portion extending from the first planar portion opposite the second end edge, and an inner surface opposite the outer surface of the bottom plate. The first lateral edge of the bottom plate may be connected to the inner surface of the first lift arm, the second lateral edge of the bottom plate may be connected to the inner surface of the second lift arm, the first end edge of the bottom plate may be connected to the first top plate proximate the first end edge of the first top plate, the second end edge of the first top plate may be connected to the bottom plate proximate the second end edge of the bottom plate, and the bottom end of the tilt lever support may be connected to the inner surface of the bottom plate. A buffer plate of the lift arm assembly may have oppositely disposed first and second end edges, and oppositely disposed first and second lateral edges, the first lateral edge being connected to the inner surface of the first lift arm, the second lateral edge being connected to the first outer surface of the tilt lever support, the first end edge of the buffer plate being connected to the inner surface of the first top plate, and the second end edge of the buffer plate being connected the inner surface of the bottom plate.

In a still further aspect of the present disclosure, a support structure for connecting a pair of components is disclosed. The support structure may include a first plate having oppositely disposed first and second end edges, an outer surface having a convex curvature as the outer surface extends from the first end edge to the second end edge of the first plate, and an inner surface opposite the outer surface. The support structure may also include a second plate having oppositely disposed first and second end edges, an outer surface having a convex curvature as the outer surface extends from the first end edge to the second end edge of the second plate, and an inner surface opposite the outer surface of the second plate. The plates may be connected and overlapping at opposite ends so that the first end edge of the first plate extends beyond the first end edge of the second plate and the second end edge of the second plate extends beyond the second end edge of the first plate Additional aspects are defined by the claims of this patent.

DETAILED DESCRIPTION

Although the following text sets forth a detailed description of numerous different embodiments, it should be understood that the legal scope of protection is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims defining the scope of protection.

It should also be understood that, unless a term is expressly defined in this patent using the sentence "As used herein, the term '_' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

Figure 1:
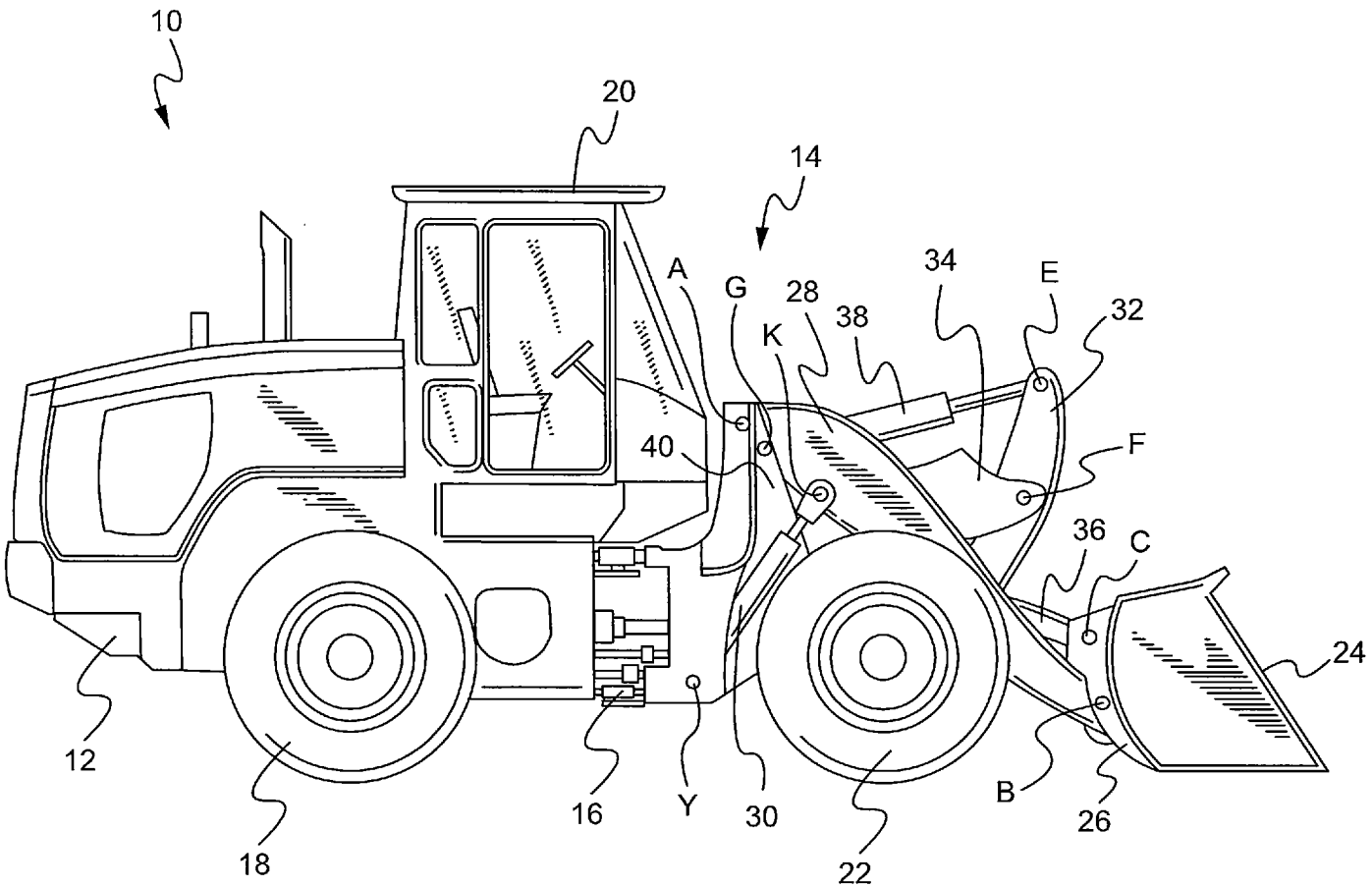
FIG. 1 is a side elevation view of a machine having an articulating ground-engaging implement and a lift arm cross member in accordance with the present disclosure.

FIG. 1 illustrates an embodiment of a wheel loader machine 10 that may implement a lift arm cross member in accordance with the present disclosure. Use of the wheel loader machine 10 as exemplary, and those skilled in the art will understand that the lift arm cross member discussed herein may be implemented in other types of machines having linkages for articulation of a ground engaging implement. The wheel loader machine 10 includes a body portion 12 and a non-engine end frame 14 connected by an articulating joint 16. The body portion 12 houses an engine that drives rear wheels 18, and includes an elevated operator environment 20, such as a cab, for the operator. The end frame 14 has front wheels 22 that are mounted to a front axle, with the articulating joint 16 allowing the end frame 14 to move from side-to-side to steer the wheel loader machine 10. In the illustrated embodiment, an implement in the form of a bucket 24 is mounted at the front of the end frame 14 on a coupler 26. The bucket 24 and coupler 26 may be configured for secure attachment of the bucket 24 during use of the wheel loader machine 10, and for release of the bucket 24 and substitution of another implement. Although the coupler 26 and bucket 24 are illustrated and described as being separate connectable components, those skilled in the art will understand that each implement, including buckets, may be configured as a unitary component having a material engaging portion, such as the bucket or forks, and a coupling portion having the points of attachment for connecting the implement to the machine 10.

The coupler 26 is connected to the end frame 14 by a pair of lift arms 28. One end of each lift arm 28 is pivotally connected to the end frame 14 and the other end is pivotally connected to the coupler 26 proximate the bottom. The lift arms 28 rotate about the point of connection to the end frame 14, with the rotation of the lift arms 28 being controlled by corresponding lift cylinders 30 pivotally coupled to the end frame 14 and the lift arms 28. The lift cylinders 30 may be extended to raise the lift arms 28 and retracted to lower the lift arms 28. In typical implementations, two lift arms 28 are provided, with each having a corresponding lift cylinder 30.

The rotation of the coupler 26 and attached implement 24 may be controlled by a Z-bar linkage of the end frame 14. The Z-bar linkage may include a tilt lever 32 pivotally connected to a tilt lever support 34 mounted on the lift arms 28 such that the tilt lever support 34 moves with the lift arms 28. At one end of the tilt lever 32, a tilt link 36 has one end pivotally connected to the end of the tilt lever 32, and the opposite end pivotally connected to the coupler 26 proximate the top. A tilt cylinder 38 couples the opposite end of the tilt lever 32 to the end frame 14 with pivotal connections at either end. For a given position of the lift arms 28, the coupler 26 and implement are rotated toward the racked position by extending the tilt cylinder 38, and rotated in the opposite direction toward the dump position by retracting the tilt cylinder 38.

Each of the connections between the elements that move with respect to one another is made by a pivot pin about which the elements rotate. Consequently, the lift arms 28 may be connected to the end frame 14 by pivot pins A and to the coupler 26 by pivot pins B. The tilt link 36 may be connected to the coupler 26 by a pivot pin C and to the tilt lever 32 by a pivot pin (not shown). The tilt lever 32 may be connected to the tilt cylinder 38 by a pivot pin E and to the tilt lever support 34 by a pivot pin F. The opposite end of the tilt cylinder 38 may be connected to the support structure of the end frame 14 by a pivot pin G, the position of which is indicated in FIG. 1 though the pivot pin G and support structure are hidden by one of the lift arms 28 and a tower plate 40. Finally, the lift cylinders 30 may be connected to the lift arms 28 by pivot pins K and to the end frame 14 by pivot pins Y. Because the pivot pins A, G, Y are attached to the end frame 14, the distance between the pivot pins A, G, Y if fixed.

Figure 2:
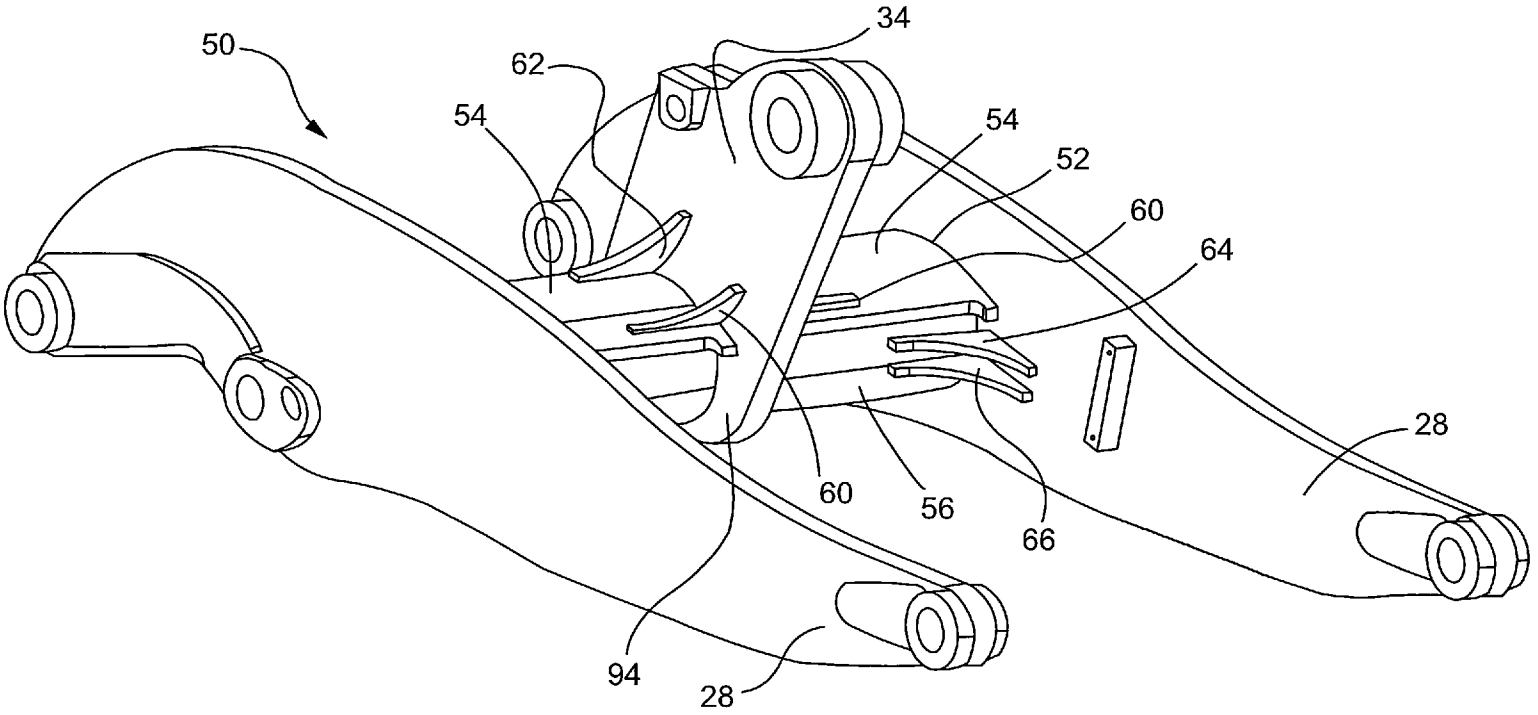
FIG. 2 is a front right perspective view of a lift arm assembly of the machine of FIG. 1.

The weight of the implement 24 and a load of work material disposed in or acted upon by the implement 24 tending to rotate the implement about the pivot pin B create forces in the tilt lever 32, tilt link 36 and the tilt cylinder 38 that are translated to the lift arms 28 by the tilt lever support 34. A lift arm assembly 50 is shown in greater detail in the perspective view of FIG. 2. The lift arm assembly 50 may include the left and right lift arms 28 and the tilt lever support 34, with the tilt lever support 34 being connected to the lift arms 28 by a support structure such as a lift arm cross member 52. The lift arm cross member 52 may include first and second cross member top plates 54 extending between and connected to corresponding outer surfaces of the tilt lever support 34 and inner surfaces of the lift arms 28. The cross member 52 may further include a cross member bottom plate 56 extending between the inner surfaces of the lift arms 28 and being connected to the tilt lever support 34 and the cross member top plate 54 as discussed more fully below.

Additional support for the loads exerted on the lift arms 28 and the tilt lever support 34 may be provided between the components of the lift arm assembly 50 by a series of gussets positioned to absorb loads created as the implement 24 engages and hauls work material at a work site. Pairs consisting of a front upper gusset 60 and a rear upper gusset 62 may connect the tilt lever support 34 to the corresponding cross member top plate 54. Each gusset 60, 62 may have an inner edge connected to a corresponding surface of the tilt lever support 34 and a bottom edge connected to a top surface of the corresponding cross member top plate 54. In supporting the weight of the implement 24 and a load of material disposed therein through the tilt lever 32, the tilt link 36 and the tilt cylinder 38, radial loads are created by the pivot pin F on the tilt lever support 34. In addition, lateral engagement of the implement 24 with work material and offset loads on the implement 24 may be transmitted through the tilt lever 32, the tilt link 36 and the tilt cylinder 38 and generate thrust or combination loads on the tilt lever support 34. The upper gussets 60, 62 may transfer these loads on the tilt lever support 34 through the cross member top plates 54 to the lift arms 28 and avoid placing undue stresses at the interface between the tilt lever support 34 and the cross member top plates 54 that are typically formed by welds.

The implement 24 may be struck from the side or hit a pile of material at an angle, or the operator may push work material with the side of the implement 24 to position the work material for loading. These activities may create thrust of combination loads at the pivot pin B that may place stress on the welds between the lift arms 28 and the lift arm cross member 52. Pairs of top front gussets 64 and bottom front gussets 66 may connect the bottom plate 56 of the lift arm cross member 52 to the inner surfaces of the corresponding lift arms 28. Outer edges of the front gussets 64, 66 may be connected to the lift arms 28, and rear edges may be connected to the outer surface of the bottom plate 56 of the cross member 52. As the thrust loads are applied at the pivot pins B, the front gussets 64, 66 assist in transferring the thrust loads to the lift arm cross member 52 and reduce the stresses on the connections between the lift arms 28 and the cross member 52.

Figure 3:
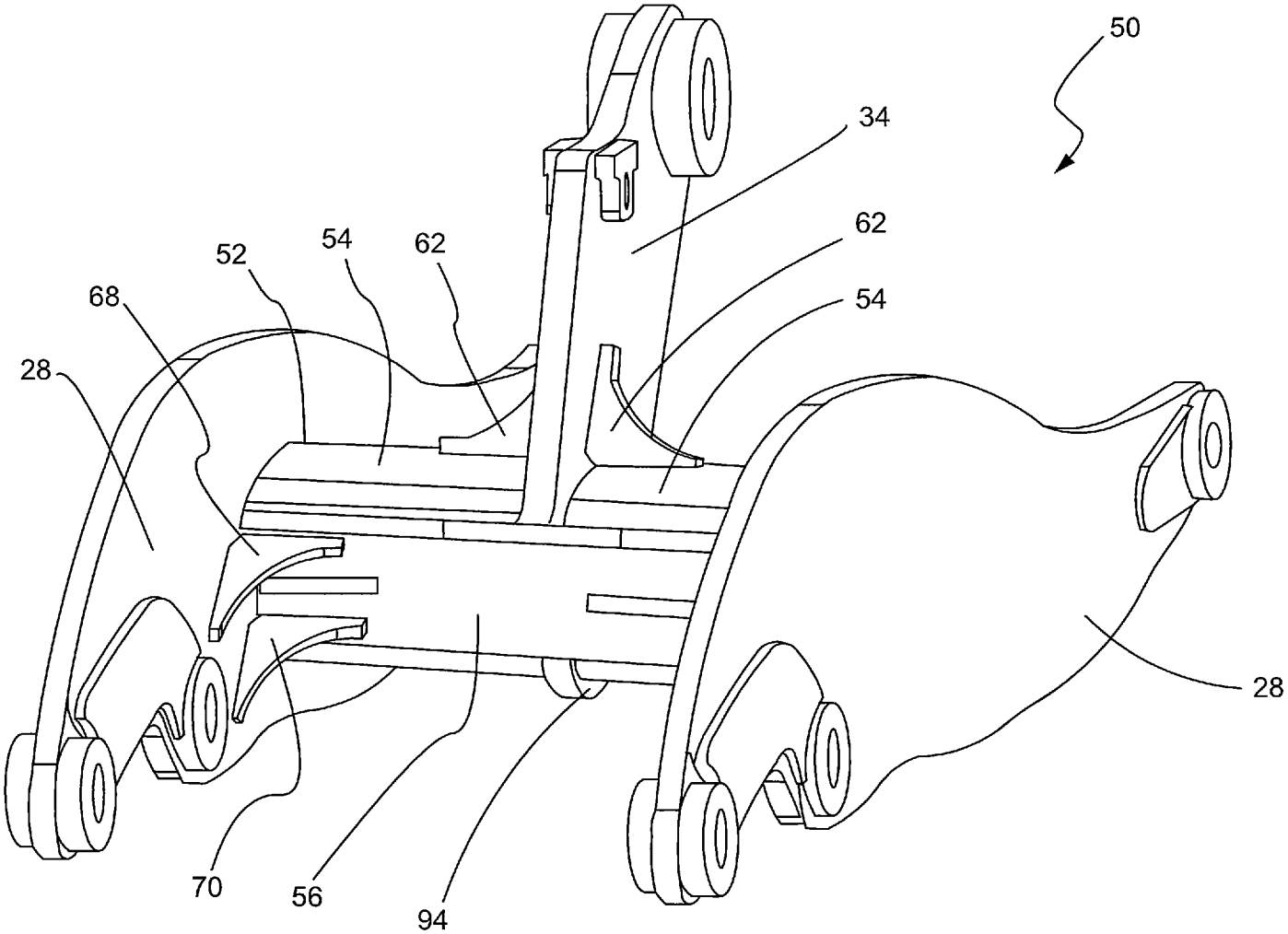
FIG. 3 is a rear right perspective view of the lift arm assembly of FIG. 2.

FIG. 3 shows a top rear gusset 68 and a bottom rear gusset 70 further unitizing the cross member bottom plate 56 to the lift arms 28. A similar pair of rear gussets 68, 70 (not visible) is provided on the opposite side of the lift arm assembly 50. Similar to the front gussets 64, 66, outer edges of the rear gussets 68, 70 may be connected to the lift arms 28, and front edges may be connected to the outer surface of the bottom plate 56 of the cross member 52. The rear gussets 68, 70 assist with bearing and transferring the radial, thrust and combination loads at the pivot pins B and F between the lift arms 28 and the lift arm cross member 52 in similar manners as described above for the gussets 60-66. Each of the gussets 60-70 may have curved outer surfaces reducing the obstruction to the operator when looking between the lift arms 28.

Figure 4:
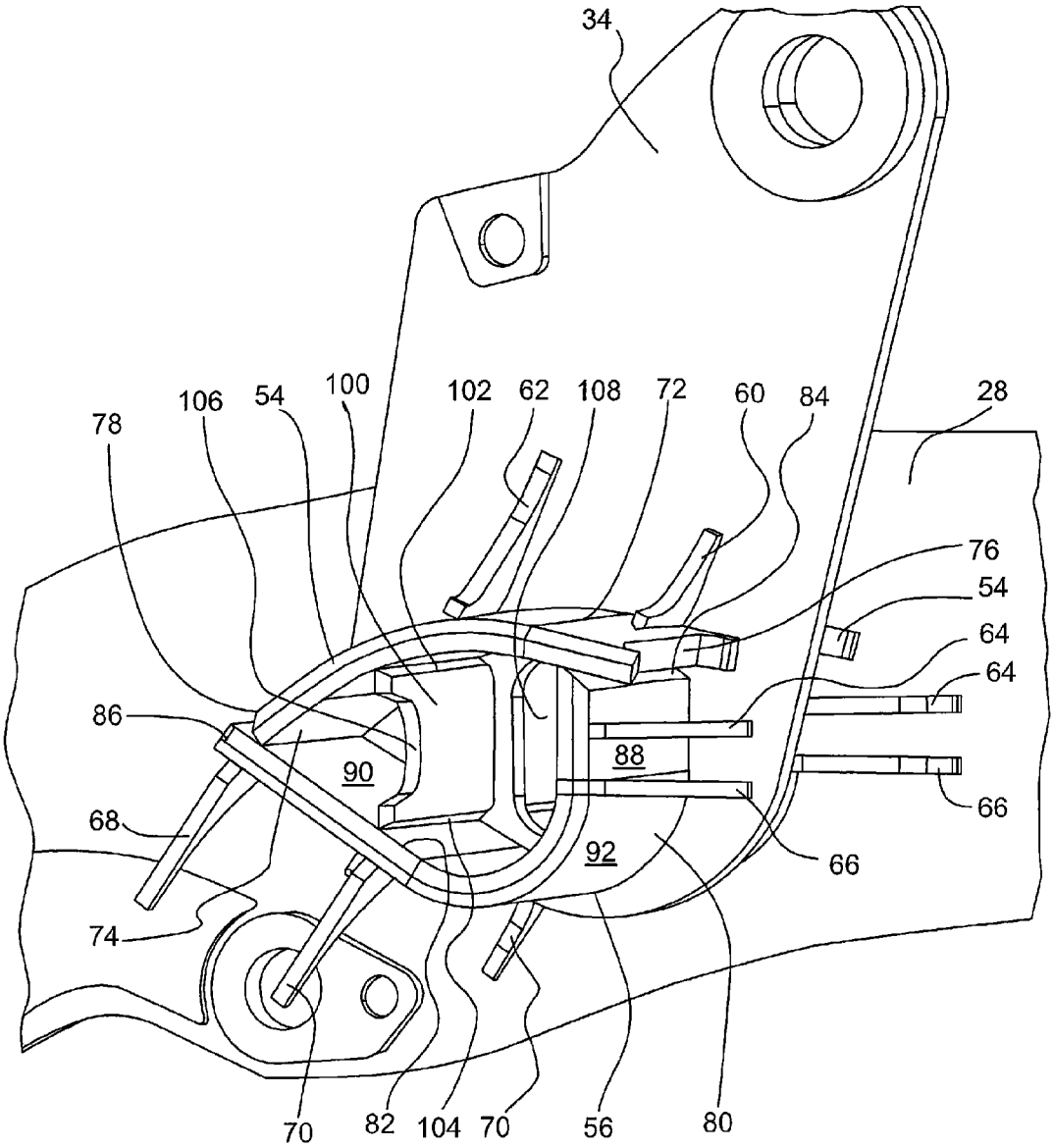
FIG. 4 is a perspective view of the lift arm assembly of FIG. 2; with the lift arm removed for clarity of illustration.

FIG. 4 more clearly illustrates the configuration of the lift arm cross member 52 with one of the lift arms 28 removed. The cross member 52 may generally have the shape of a human eye based on the contours of the top plate 54 and the bottom plate 56. The top plate 54 may be generally curved and have a convex top or outer surface 72, a concave bottom or inner surface 74, a front end edge 76 and a rear end edge 78. The end edges 76, 78 may be generally flat with the convex curvature of the outer surface 72 occurring as the outer surface 72 extends from the front end edge 76 to the rear end edge 78. The inner lateral edges of the top plates 54 may be welded or otherwise connected to the corresponding outer surfaces of the tilt lever support 34, and the outer lateral edges may be connected to inner surfaces of the corresponding lift arms 28.

The bottom plate 56 may be generally curved as well, with a convex bottom or outer surface 80, a concave top or inner surface 82, a front end edge 84 and a rear end edge 86. Similar to the top plate 54, the end edges 84, 86 may be generally flat with the convex curvature of the outer surface 80 occurring as the outer surface 80 extends from the front end edge 84 to the rear end edge 86. The bottom plate 56 may have a discernable front planar portion 88 extending from the front end edge 84, a rear planar portion 90 extending from the rear end edge 86, and an intermediate curved portion 92 extending between the planar portions 88, 90. The planar portions 88, 90 may be oriented relative to each other at an acute angle that is greater than 0° so that the planar portions 88, 90 are not parallel and less than 90° so that the planar portions 88, 90 are not perpendicular. This shape in cooperation with the convex shape of the outer surface 72 of the top plate 54 may form a human eye-shaped profile of the lift arm cross member 52 when viewed from the side.

Figure 5:
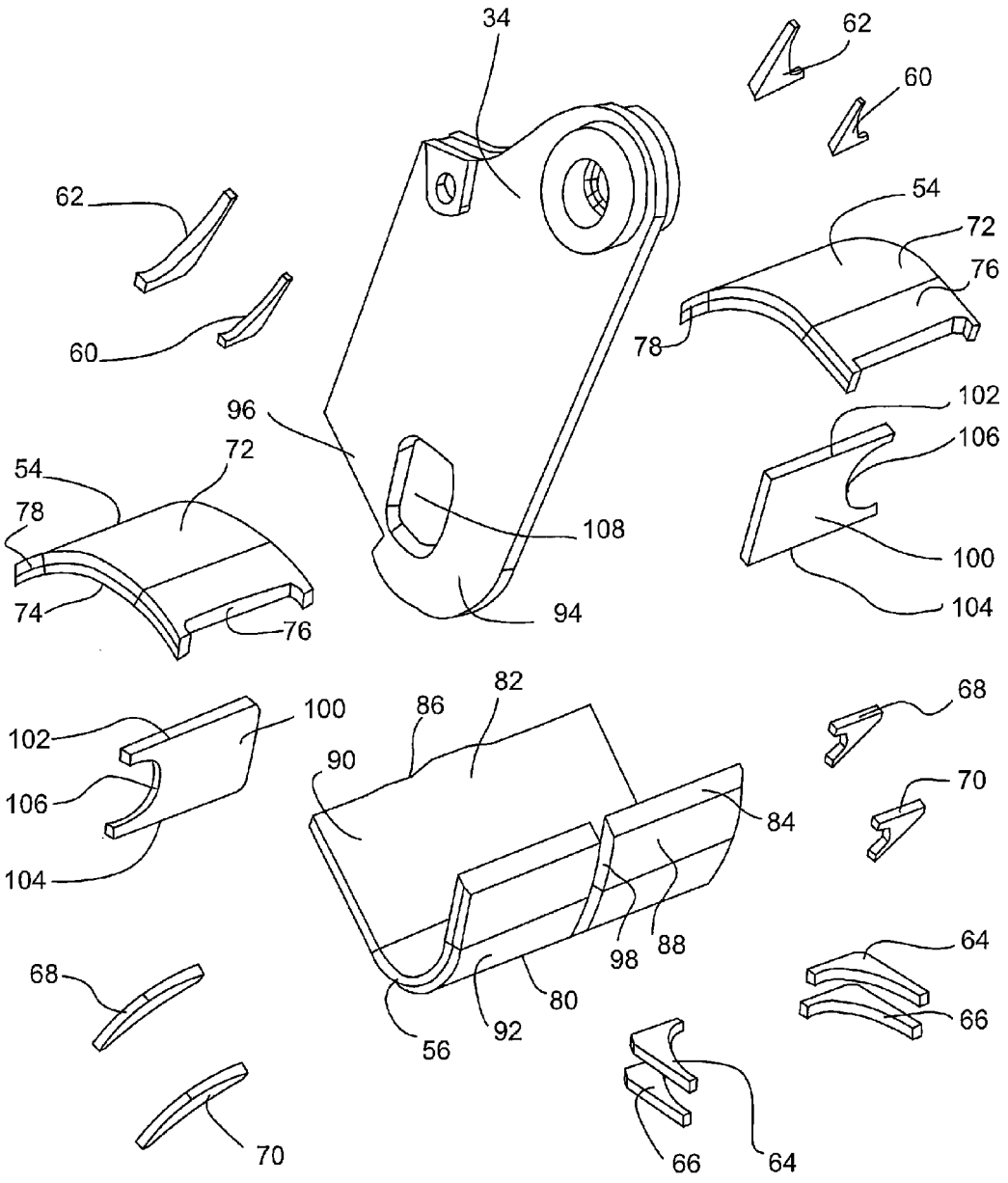
FIG. 5 is an exploded view of the tilt lever support and lift arm cross member of the lift arm assembly of FIG. 2.

In the present embodiment, the bottom plate 56 may be a single, continuous plate extending the entire width between the lift arms 28 and having oppositely disposed lateral edges of the bottom plate 56 connected to the corresponding inner surfaces of the lift arms 28. FIG. 5 is an exploded view of the components of the tilt lever support 34 and the lift arm cross member 52. Proximate a bottom end 94, the tile lever support 34 may include a cutout or notch 96 proximate the rear of the support 34, and the cross member bottom plate 56 may include a slot 98 in the front planar portion 88 and intermediate curved portion 92 for receiving the bottom end 94 of the support 34. During assembly, the bottom end 94 may be inserted through the slot 98 with the surface of the notch 96 abutting the inner surface 82 at the rear planar portion 90. The embodiment shown herein is illustrative only and other configurations are possible. For example, the bottom plate 56 may have a two-piece construction similar to the top plate 54, or both plates 54, 56 could be unitary components with the tilt lever support 34 being connected to the outer surface 72 of the top plate 54 or having an opening through which the assembled cross member 52 is inserted and secured. Of course, other configurations are possible and are contemplated by the inventors as having use in lift arm assemblies 50 in accordance with the present disclosure.

As shown in FIGS. 4 and 5, additional structural support may be provided by a buffer plate 100 extending between the inner surfaces 74 of the top plates 54 and the inner surface 82 of the bottom plate 56. A top end edge 102 of each buffer plate 100 may be connected to the inner surface 74 of the top plate 54, and a bottom end edge 104 may be connected to the inner surface 82. Similar to the top plates 54, the buffer plates 100 may have lateral edges connected to corresponding outer surfaces of the tilt lever support 34 and to the inner surfaces of the corresponding lift arms 28. If desired or necessary, cutouts 106 may be provided at the outer lateral edges of the buffer plates 100 to relieve localized stresses. Without the buffer plates 100, loads on the tilt lever support 34 and the resulting stresses would be concentrated on the center welds between the tilt lever support 34, the top plate 54 and the bottom plate 56. In the present design, the buffer plates 100 may serve as a unitizing structure that further transfers the load from the tilt lever 32 through the cross member 52 to the lift arms 28. The additional support provided by buffer plates 100 may allow for the formation of an opening 108 through the tilt lever support 34 to reduce the weight of the lift arm assembly 50.

Figure 6:
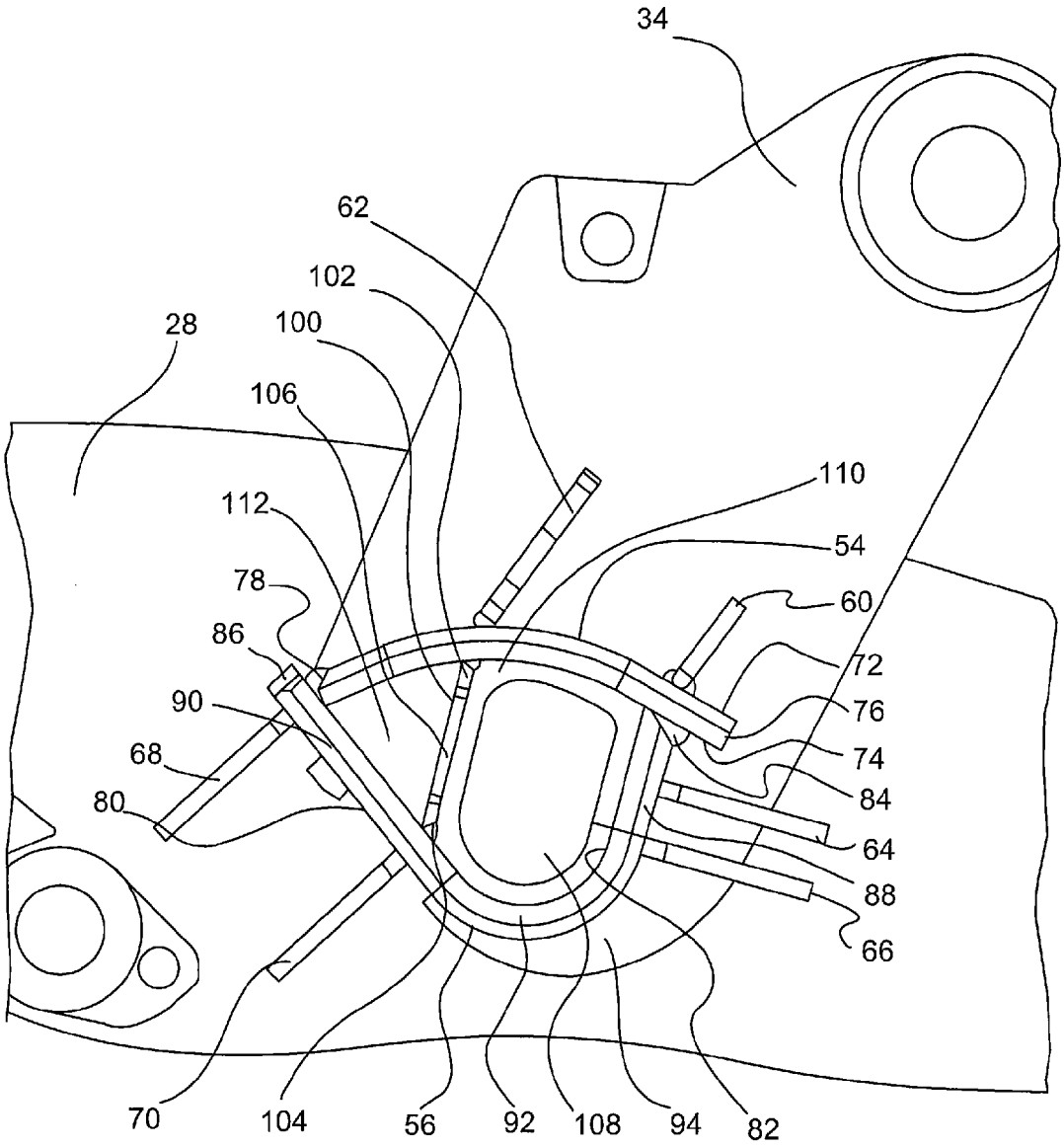
FIG. 6 is a side view of the lift arm assembly of FIG. 2, with the lift arm removed for clarity of illustration.

The side view of FIG. 6 more clearly illustrates the orientation of the components of the lift arm cross member 52 on the lift arms 28 and the tilt lever support 34. The cross member top plates 54 may be disposed above the bottom plates 56 with the opposite end edge pairs 76/84, 78/86 of the plates 54, 56 overlapping in an alternated arrangement such that the front end edge 76 of the top plate 54 extends beyond the front end edge 84 of the bottom plate 56 and the rear end edge 86 of the bottom plate 56 extends beyond the rear end edge 78 of the top plate 54. As a result, the front end edge 84 of the bottom plate 56 may abut the inner surface 74 of the top plate 54 proximate the front end edge 76 of the top plate 54, and the rear end edge 78 of the top plate 56 may abut the inner surface 82 of the bottom plate 56 proximate the rear end edge 86 of the bottom plate 56. In one alternate arrangement, the front end edge 76 may abut the inner surface 82 and the rear end edge 86 may abut the inner surface 74. The buffer plate 100 may extend between the inner surface 74 of the top plate 54 and the inner surface 82 of the bottom plate 56 with an orientation approximately parallel to the front planar portion 88 of the bottom plate 56. The buffer plate 100 may form a front cavity 110 in which the opening 108 is located and a generally triangular shaped rear cavity 112. It may be possible to form a similar cutout in the tilt lever support 34 within the rear cavity 112 if desired to further reduce the weight of the lift arm assembly 50.

FIG. 6 further illustrates that the gussets 60, 62, 68, 70 may be positioned to align with points of intersection between the top plate 54, the bottom plate 56 and the buffer plate 100 to further reinforce the connections between the plates 54, 56, 100 which are typically in the form of welds. The front upper gusset 60 may be attached at the outer surface 72 of the top plate 54 at a position opposite the point of attachment of the front end edge 84 of the bottom plate 56 to the inner surface 74 of the top plate 54. Similarly, the upper edge of the top rear gusset 68 may be attached at the outer surface 80 of the bottom plate 56 at a position opposite the point of attachment of the rear end edge 78 of the top plate 54 to the inner surface 82 of the bottom plate 56.

The rear upper gussets 62 and the bottom rear gussets 70 may provide additional support for the buffer plates 100. The bottom edge of each rear upper gusset 62 may be attached at the outer surface 72 of the top plate 54 approximately opposite the connection between the upper edge of the buffer plate 100 and the inner surface 74 of the top plate 54. In a similar manner, the top edge of each bottom rear gusset 70 may be attached at the outer surface 80 of the bottom plate 56 approximately opposite the connection between the bottom edge of the buffer plate 100 and the inner surface 82 of the bottom plate 56. As shown in FIG. 6, the positioning of the gussets 60, 62, 68, 70 provides reinforcement for each of the welds extending outwardly from the tilt lever support 34 to the lift arms 28 to prevent failure of the lift arm assembly 50 at locations that may be the weakest structures of the lift arm assembly 50.

INDUSTRIAL APPLICABILITY

Figure 8:
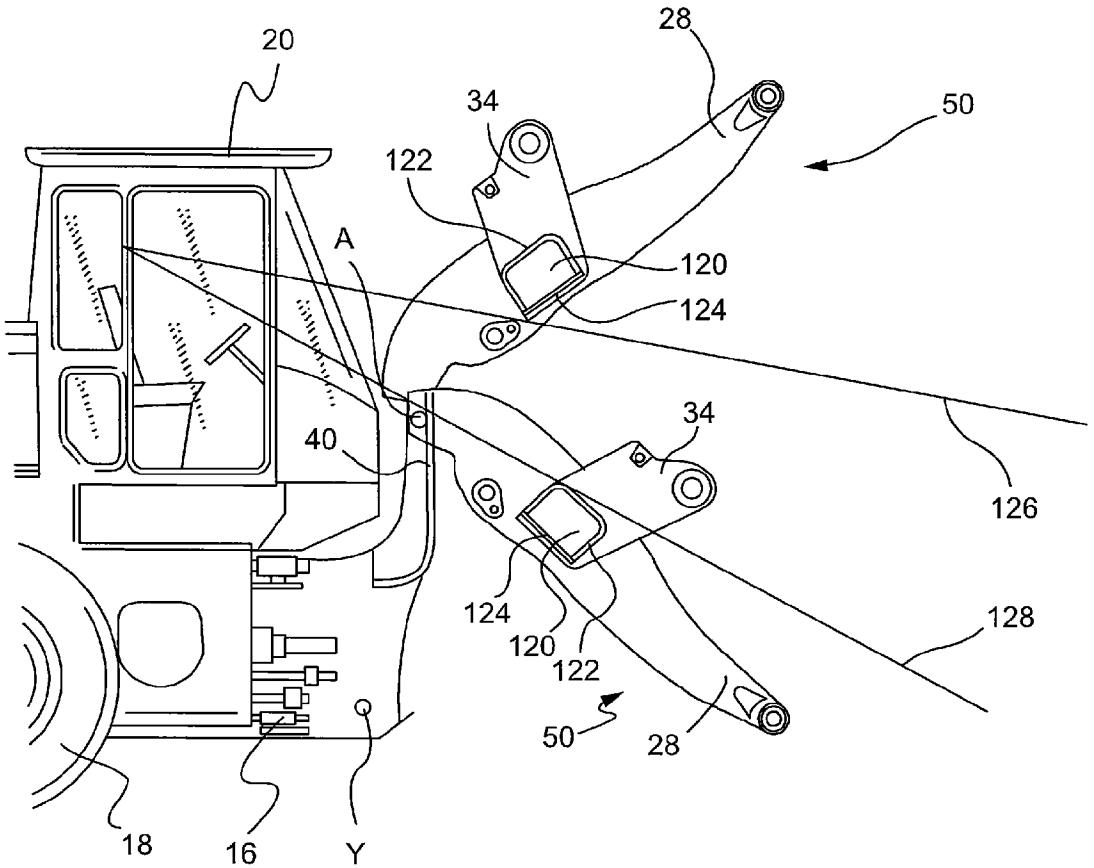
FIG. 8 (Prior Art)
FIG. 8 is a schematic illustration of the machine of FIG. 1 having a lift arm assembly with a prior art lift arm cross member in lowered and raised positions.

The lift arm assembly 50 having the lift arm cross member 52 in accordance with the present disclosure provides an operator with improved visibility during the operation of the machine 10 without compromising the strength and integrity of the lift arm assembly 50. FIG. 8 illustrates the machine 10 having a prior art lift arm cross member 120 connecting the tilt lever support 34 to the lift arms 28. The prior art lift arm cross member 120 has a generally rectangular or box-like shape wherein a three-sided top plate 122 and a flat bottom plate 124 may be the only components of the cross member 120. With this configuration of the cross member 120, the amount of obstruction for the operator in looking between the lift arms 28 may be demarcated by the corners of the cross member 120. When the lift arm assembly 50 is raised to dump a load of material, a bottom rear corner of the cross member 120 may define a dump visibility line 126 above which the operator's view between the lift arms 28 is obstructed by the cross member 120. When the lift arm assembly 50 is lowered to the ground to gather a load of work material, a top rear corner of the cross member 120 defines a ground visibility line 128 below which the operator's view is obstructed. Cross members 120 of this type, unfortunately, cannot merely be shrunk to shift the visibility lines 126, 128 and to reduce the amount of obstruction because the cross member 120 will lose strength and present a risk of failure during operation of the machine 10.

Figure 7:
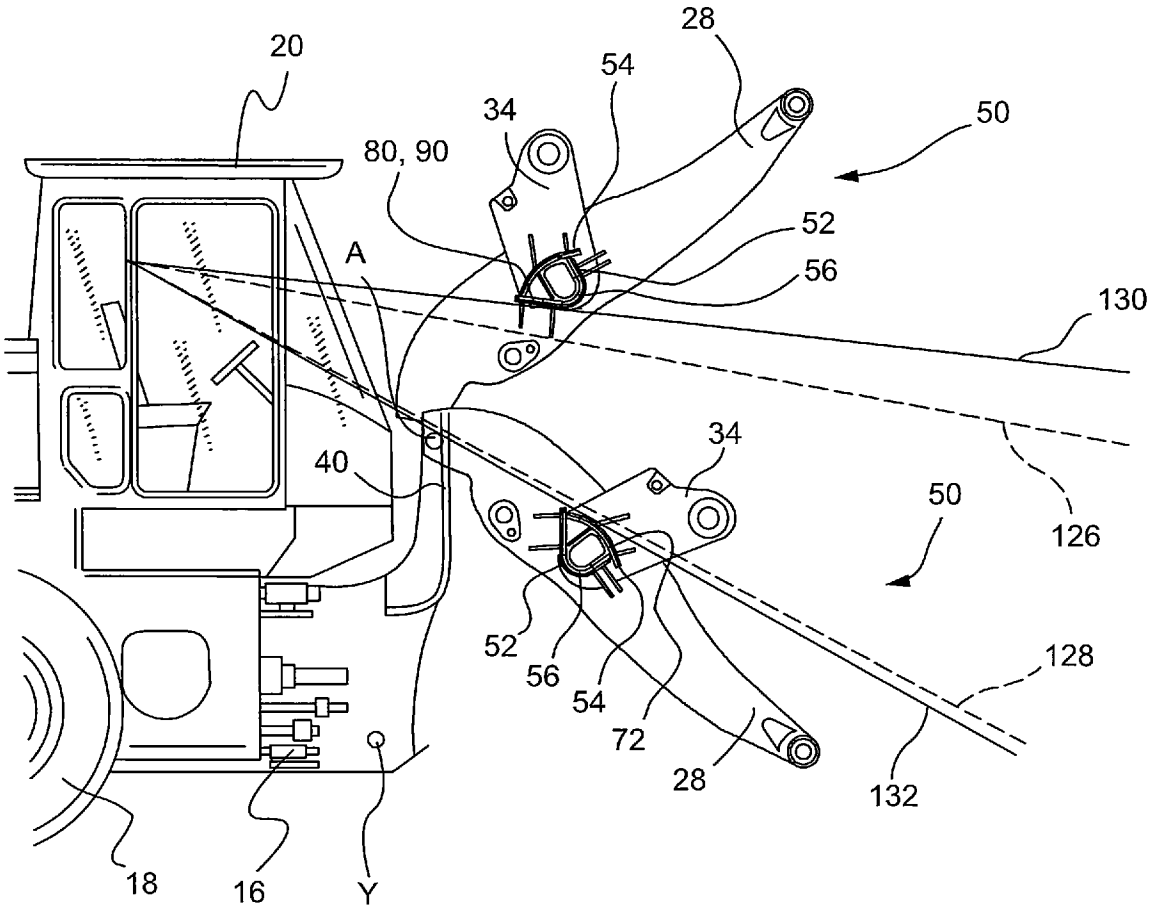
FIG. 7 is a schematic illustration of the machine of FIG. 1 having a lift arm assembly with a lift arm cross member in accordance with the present disclosure in lowered and raised positions.

The lift arm cross member 52 in accordance with the present disclosure maintains the required strength and structural integrity while increasing the visibility afforded to the operator of the machine 10. As shown in FIG. 7, the lift arm cross member 52 is positioned at the same location as the cross member 120, but reduces the obstruction to the operator's view through the contours of the top plate 54 and bottom plate 56 of the cross member 52. When the lift arm assembly 50 is raised to dump a load, the outer surface 80 at the rear planar portion 90 of the cross member bottom plate 56 defines the upper limit of the operator's view before being obstructed by the cross member 52. Consequently, a dump visibility line 130 defined by the cross member 52 is higher than the dump visibility line 126 defined by the bottom rear corner of the cross member 120. This provides the operator with an improved view of the truck, bin or other container into which a load of material is being dumped. At the opposite extreme, the outer surface 72 of the top plate 54 defines the lower limit for the operator to view a pile of work material from which a load of material will be extracted. A ground visibility line 132 when the lift arm assembly 50 is lowered may be lower than the ground visibility line 128 defined by the top rear corner of the lift arm cross member 120.

As is apparent from the positions of the dump visibility lines 126, 130 and ground visibility lines 128, 132 as illustrated in FIG. 7, the lower, thinner profile of the lift arm cross member 52 provides the operator with a wider field of view of the work area and the work material on which the machine 10 is operating. At the same time, the configuration of the lift arm cross member 52 may provide weight and material savings in the configuration of the cross member plates 54, 56 and the ability to remove material from other components of the lift arm assembly 50, such as the opening 108 through the tilt lever support 34. The improvement in visibility is obtained without compromising the strength and integrity of the lift arm assembly 50. The buffer plates 100 may provide additional internal support for the lift arm cross member 52 and assist in transferring loads from the tilt lever support 34 to the lift arms 28. Moreover, the external gussets 60-70 further assist in supporting and transmitting loads between the lift arms 28 and the tilt lever support 34, and in reducing stresses created on the welds between the lift arms 28, the tilt lever support 34 and the lift arm cross member 52.

While the preceding text sets forth a detailed description of numerous different embodiments, it should be understood that the legal scope of protection is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims defining the scope of protection.

What is claimed is:

1. A lift arm cross member for connecting a tilt lever support of a machine between a pair of lift arms of the machine, comprising:

a first plate having oppositely disposed first and second end edges, oppositely disposed first and second lateral edges, an outer surface having a convex curvature as the outer surface extends from the first end edge to the second end edge, and an inner surface opposite the outer surface, the first lateral edge of the first plate being connected to an inner surface of one of the lift arms;

a second plate having oppositely disposed first and second end edges, oppositely disposed first and second lateral edges, an outer surface having a first planar portion proximate the second end edge and a curved portion extending from the first planar portion opposite the second end edge, and an inner surface opposite the outer surface of the second plate, the first lateral edge of the second plate being connected to the inner surface of the lift arm to which the first lateral edge of the first plate is connected, the first end edge of the second plate being connected to the first plate proximate the first end edge of the first plate, and the second end edge of the first plate being connected to the second plate proximate the second end edge of the second plate; and a buffer plate having oppositely disposed first and second end edges, and oppositely disposed first and second lateral edges, the first lateral edge being connected to the inner surface of the lift arm to which the first lateral edge of the first plate is connected, the first end edge of the buffer plate being connected to the inner surface of the first plate, and the second end edge of the buffer plate being connected the inner surface of the second plate, the outer surface of the second plate comprising a second planar portion extending from the first end edge of the second plate to the curved portion of the outer surface of the second plate, the first and second planar portions being oriented with respect to each other at an acute angle greater than 0° and less than 90°, and the buffer plate being parallel to the second planar portion.

2. The lift arm cross member of claim 1, with the first end edge of the second plate being connected to the inner surface of the first plate proximate the first end edge of the first plate, and the second end edge of the first plate being connected to the inner surface of the second plate proximate the second end edge of the second plate.

3. The lift arm cross member of claim 2, comprising:

a first gusset having a first edge connected to a first outer surface of the tilt lever support and a second edge connected to the outer surface of the first plate opposite the connection of the first end edge of the second plate to the inner surface of the first plate; and a second gusset having a first edge connected to the inner surface of the lift arm to which the first lateral edge of the first plate is connected and a second edge connected to the outer surface of the second plate opposite the connection of the second end edge of the first plate to the inner surface of the second plate.

4. The lift arm cross member of claim 1, comprising a third plate having oppositely disposed first and second end edges, oppositely disposed first and second lateral edges, an outer surface having a convex curvature corresponding to the convex curvature of the first plate as the outer surface extends from the first end edge to the second end edge, and an inner surface opposite the outer surface, the first lateral edge of the third plate being connected to an inner surface of the other of the lift arms, the second lateral edge of the first plate being connected to a first outer surface of the tilt lever support and the second lateral edge of the third plate being connected to a second outer surface of the tilt lever support opposite the second lateral edge of the first plate.

5. The lift arm cross member of claim 1, the second lateral edge of the second plate being connected to an inner surface of the other of the lift arms, and a bottom end of the tilt lever support being connected to the inner surface of the second plate.

6. The lift arm cross member of claim 5, the second plate comprising a surface defining a slot extending inwardly from the first end edge of the second plate toward the second end edge with a portion of the tilt lever support extending through the slot when the bottom end is connected to the inner surface of the second plate.

7. A lift arm cross member for connecting a tilt lever support of a machine between a pair of lift arms of the machine, comprising:

a first plate having oppositely disposed first and second end edges, oppositely disposed first and second lateral edges, an outer surface having a convex curvature as the outer surface extends from the first end edge to the second end edge, and an inner surface opposite the outer surface, the first lateral edge of the first plate being connected to an inner surface of one of the lift arms;

a second plate having oppositely disposed first and second end edges, oppositely disposed first and second lateral edges, an outer surface having a first planar portion proximate the second end edge and a curved portion extending from the first planar portion opposite the second end edge, and an inner surface opposite the outer surface of the second plate, the first lateral edge of the second plate being connected to the inner surface of the lift arm to which the first lateral edge of the first plate is connected, the first end edge of the second plate being connected to the first plate proximate the first end edge of the first plate, and the second end edge of the first plate being connected to the second plate proximate the second end edge of the second plate a buffer plate having oppositely disposed first and second end edges, and oppositely disposed first and second lateral edges, the first lateral edge being connected to the inner surface of the lift arm to which the first lateral edge of the first plate is connected, the first end edge of the buffer plate being connected to the inner surface of the first plate, and the second end edge of the buffer plate being connected the inner surface of the second plate a first gusset having a first edge connected to a first outer surface of the tilt lever support and a second edge connected to the outer surface of the first plate opposite the connection of the first end edge of the buffer plate to the inner surface of the first plate; and a second gusset having a first edge connected to the inner surface of the lift arm to which the first lateral edge of the first plate is connected and a second edge connected to the outer surface of the second plate opposite the connection of the second end edge of the buffer plate to the inner surface of the second plate.

8. A lift arm cross member for connecting a tilt lever support of a machine between a pair of lift arms of the machine, comprising:

a first top plate having oppositely disposed first and second end edges, oppositely disposed first and second lateral edges, an outer surface having a convex curvature as the outer surface extends from the first end edge to the second end edge, and an inner surface opposite the outer surface, the first lateral edge of the first top plate being connected to an inner surface of one of the lift arms;

a bottom plate having oppositely disposed first and second end edges, oppositely disposed first and second lateral edges, an outer surface having a first planar portion proximate the second end edge and a curved portion extending from the first planar portion opposite the second end edge, and an inner surface opposite the outer surface of the bottom plate, the first lateral edge of the bottom plate being connected to the inner surface of the lift arm to which the first lateral edge of the first top plate is connected, the first end edge of the bottom plate being connected to the first top plate proximate the first end edge of the first top plate, and the second end edge of the first top plate being connected to the bottom plate proximate the second end edge of the bottom plate; and a buffer plate having oppositely disposed first and second end edges, and oppositely disposed first and second lateral edges, the first lateral edge being connected to the inner surface of the lift arm to which the first lateral edge of the first top plate is connected, the first end edge of the buffer plate being connected to the inner surface of the first top plate, and the second end edge of the buffer plate being connected the inner surface of the bottom plate, the outer surface of the bottom plate comprising a second planar portion extending from the first end edge of the bottom plate to the curved portion of the outer surface of the bottom plate, the first and second planar portions being oriented with respect to each other at an acute angle greater than 0° and less than 90°, and the buffer plate being parallel to the second planar portion.

9. The lift arm cross member of claim 8, with the first end edge of the bottom plate being connected to the inner surface of the first top plate proximate the first end edge of the first top plate, and the second end edge of the first top plate being connected to the inner surface of the bottom plate proximate the second end edge of the bottom plate.

10. The lift arm cross member of claim 9, comprising:

a first gusset having a first edge connected to a first outer surface of the tilt lever support and a second edge connected to the outer surface of the first top plate opposite the connection of the first end edge of the bottom plate to the inner surface of the first top plate;

a second gusset having a first edge connected to the inner surface of the lift arm to which the first lateral edge of the first top plate is connected and a second edge connected to the outer surface of the bottom plate opposite the connection of the second end edge of the first top plate to the inner surface of the bottom plate;

a third gusset having a first edge connected to the first outer surface of the tilt lever support and a second edge connected to the outer surface of the first top plate opposite the connection of the first end edge of the buffer plate to the inner surface of the first top plate; and a fourth gusset having a first edge connected to the inner surface of the lift arm to which the first lateral edge of the first top plate is connected and a second edge connected to the outer surface of the bottom plate opposite the connection of the second end edge of the buffer plate to the inner surface of the bottom plate.

11. The lift arm cross member of claim 8, comprising a second top plate having oppositely disposed first and second end edges, oppositely disposed first and second lateral edges, an outer surface having a convex curvature corresponding to the convex curvature of the outer surface of the first top plate as the outer surface extends from the first end edge to the second end edge of the second top plate, and an inner surface opposite the outer surface, the first lateral edge of the second top plate being connected to an inner surface of the other of the lift arms, the second lateral edge of the first top plate being connected to a first outer surface of the tilt lever support and the second lateral edge of the second top plate being connected to a second outer surface of the tilt lever support opposite the second lateral edge of the first top plate.

12. The lift arm cross member of claim 8, the second lateral edge of the bottom plate being connected to an inner surface of the other of the lift arms, and a bottom end of the tilt lever support being connected to the inner surface of the bottom plate.

13. A lift arm assembly of a machine, comprising:

a first lift arm having an inner surface and an outer surface;

a second lift arm having an inner surface and an outer surface;

a tilt lever support having first outer surface, a second outer surface disposed opposite the first outer surface, and a bottom end;

a first top plate having oppositely disposed first and second end edges, oppositely disposed first and second lateral edges, an outer surface having a convex curvature as the outer surface extends from the first end edge to the second end edge, and an inner surface opposite the outer surface, the first lateral edge of the first top plate being connected to the inner surface of the first lift arm, and the second lateral edge of the first top plate being connected to the first outer surface of the tilt lever support;

a bottom plate having oppositely disposed first and second end edges, oppositely disposed first and second lateral edges, an outer surface having a first planar portion proximate the second end edge and a curved portion extending from the first planar portion opposite the second end edge, and an inner surface opposite the outer surface of the bottom plate, the first lateral edge of the bottom plate being connected to the inner surface of the first lift arm, the second lateral edge of the bottom plate being connected to the inner surface of the second lift arm, the first end edge of the bottom plate being connected to the first top plate proximate the first end edge of the first top plate, the second end edge of the first top plate being connected to the bottom plate proximate the second end edge of the bottom plate, and the bottom end of the tilt lever support being connected to the inner surface of the bottom plate; and a buffer plate having oppositely disposed first and second end edges, and oppositely disposed first and second lateral edges, the first lateral edge being connected to the inner surface of the first lift arm, the second lateral edge being connected to the first outer surface of the tilt lever support, the first end edge of the buffer plate being connected to the inner surface of the first top plate, and the second end edge of the buffer plate being connected the inner surface of the bottom plate, with the outer surface of the bottom plate comprising a second planar portion extending from the first end edge of the bottom plate to the curved portion of the outer surface of the bottom plate, the first and second planar portions being oriented with respect to each other at an acute angle greater than 0° and less than 90°, and the buffer plate being parallel to the second planar portion.

14. The lift arm assembly of claim 13, with the first end edge of the bottom plate being connected to the inner surface of the first top plate proximate the first end edge of the first top plate, and the second end edge of the first top plate being connected to the inner surface of the bottom plate proximate the second end edge of the bottom plate.

15. The lift arm assembly of claim 14, comprising:

a first gusset having a first edge connected to the first outer surface of the tilt lever support and a second edge connected to the outer surface of the first top plate opposite the connection of the first end edge of the bottom plate to the inner surface of the first top plate;

a second gusset having a first edge connected to the inner surface of the first lift arm and a second edge connected to the outer surface of the bottom plate opposite the connection of the second end edge of the first top plate to the inner surface of the bottom plate;

a third gusset having a first edge connected to the first outer surface of the tilt lever support and a second edge connected to the outer surface of the first top plate opposite the connection of the first end edge of the buffer plate to the inner surface of the first top plate; and a fourth gusset having a first edge connected to the inner surface of the first lift arm and a second edge connected to the outer surface of the bottom plate opposite the connection of the second end edge of the buffer plate to the inner surface of the bottom plate.

16. The lift arm assembly of claim 13, comprising a second top plate having oppositely disposed first and second end edges, oppositely disposed first and second lateral edges, an outer surface having a convex curvature corresponding to the convex curvature of the outer surface of the first top plate as the outer surface extends from the first end edge to the second end edge of the second top plate, and an inner surface opposite the outer surface, the first lateral edge of the second top plate being connected to the inner surface of the second lift arm, and the second lateral edge of the second top plate being connected to the second outer surface of the tilt lever support.

* * * * *